US006681667B2

(12) United States Patent
Kohda et al.

(10) Patent No.: US 6,681,667 B2
(45) Date of Patent: Jan. 27, 2004

(54) SHEET CUTTER

(75) Inventors: Hiroyuki Kohda, Kanagawa (JP); Shigeki Morisawa, Mie-ken (JP); Masayuki Ohyane, Kagawa-ken (JP); Tokihiko Kobayashi, Mie-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 114 days.

(21) Appl. No.: 09/852,654

(22) Filed: May 11, 2001

(65) Prior Publication Data

US 2001/0039866 A1 Nov. 15, 2001

(30) Foreign Application Priority Data

May 11, 2000 (JP) ..... 2000-139053

(51) Int. Cl.[7] ..... B26D 7/00

(52) U.S. Cl. ..... 83/167; 83/455; 83/487; 83/583; 83/614

(58) Field of Search ..... 83/614, 455, 487, 83/485, 583, 167

(56) References Cited

U.S. PATENT DOCUMENTS 985,446 A * 2/1911 Pease ..... 83/459
3,370,497 A * 2/1968 Busse ..... 83/455
4,383,458 A * 5/1983 Kitai et al. ..... 83/405
4,722,255 A * 2/1988 Choate et al. ..... 83/23
4,979,838 A * 12/1990 Yokota et al. ..... 400/621
5,613,415 A * 3/1997 Sanpei ..... 83/86
5,787,778 A * 8/1998 Saito et al. ..... 83/383
5,974,929 A * 11/1999 Kugel et al. ..... 83/582
6,286,403 B1 * 9/2001 Rosenthal et al. ..... 83/215
6,302,602 B1 * 10/2001 Kiyohara et al. ..... 400/593
6,302,605 B1 * 10/2001 Kanbe ..... 400/621
6,315,474 B1 * 11/2001 Giles et al. ..... 400/621

FOREIGN PATENT DOCUMENTS

WO WO 9916590 A1 * 4/1999 ..... B26B/1/04

* cited by examiner

*Primary Examiner*—Allan N. Shoap
*Assistant Examiner*—Isaac Hamilton
(74) *Attorney, Agent, or Firm*—Sughrue Mion, PLLC

(57) ABSTRACT

A sheet cutter for cutting a sheet by shearing. The sheet cutter has a fixed blade, a movable blade which is movable along the fixed blade, and a receiving element which receives a sheet piece which is cut off from the sheet. The receiving element is structured so as to be movable together with the movable blade as the movable blade moves. The receiving element may be structured such that it is translationally movable in a direction substantially perpendicular to the moving direction of the movable blade.

18 Claims, 10 Drawing Sheets

SHEET CUTTER

BACKGROUND OF THE INVENTION

1. Field of the Invention

The present invention relates to a sheet cutter for cutting a sheet, for example, a paper strip, thin film, cloth or the like that is adapted for image-formation.

2. Description of the Related Art

In an ordinary thermal-transfer type image-forming apparatus in which an image exposed on a photosensitive material is thermally transferred onto an image-receiving sheet, the photosensitive material is firstly unwound and pulled out by a certain length from a magazine, and thereafter a piece or sheet of photosensitive material is cut off therefrom. The sheet-form piece of photosensitive material is then conveyed to an exposure section.

In the exposure section, an image is exposed onto the photosensitive material. The image-exposed photosensitive material then has water applied thereto, and is thereafter conveyed to a transfer section. In the transfer section, the photosensitive material is overlapped with the image-receiving sheet, wound together wit h the image-receiving sheet around a heating drum, and pressed onto the heating drum by an endless belt for a predetermined length of time, so that the image on the photosensitive material is thermally transferred to the image-receiving sheet.

The image-receiving sheet is accommodated in a magazine in a coiled state. After a predetermined length of the image-receiving sheet has been unwound, a desired length of the image-receiving sheet is cut off by a sheet cutter 92 for cutting the image-receiving sheet, as shown in FIGS. 7 and 8. The cut-off image-receiving sheet is then conveyed to a transfer section.

The sheet cutter 92 features a rotary blade 98 and a fixed blade 94 with an elongated plate shape. When the rotary blade 98 is moved along the fixed blade 94 while rotating, an image-receiving sheet P which is conveyed and is situated over the fixed blade 94 is cut by an engaging portion between the rotary blade 98 and the fixed blade 94.

In the structure of this sheet cutter 92, if there was not a receiving member 100 for supporting the cut-off portion or piece of the image-receiving sheet P during cutting, burrs K and warp would inevitably be generated at an edge of the piece of the image-receiving sheet P, as shown in FIG. 9. Thus, when the sheet piece was overlapped with a photosensitive material, a small clearance C would be generated therebetween due to the burrs and warp, as shown in FIG. 10, which might cause a poor picture e.g., a so-called "white clarity".

In actuality, the real receiving member 100 needs to have a substantial length so as to correspond to the long moving length of the fixed blade, because the receiving member 100 must be layed along the fixed blade, thereby increasing the cost of manufacture. Further, relative positioning between the rotary blade 98 and the receiving member 100 must be accurate all along the moving length. Consequently, assembly costs are increased.

SUMMARY OF THE INVENTION

In light of the above-mentioned fact, an object of the present invention is to provide a labor-saving and compact sheet cutter.

Another object of the present invention is to provide a sheet cutter in which relative positioning between a rotary blade and a receiving member during a cutting process may be precisely and properly ensured.

A further object of the present invention is to provide a sheet cutter which is capable of avoiding generation of burrs and warp at a sheet edge of a piece of an image-receiving sheet that is cut off.

A still further object of the present invention is to provide an image-forming apparatus having an improved sheet cutter.

According to the present invention, there is provided a sheet cutter for cutting a sheet piece from a sheet by shearing, the sheet cutter having: a fixed blade; a movable blade which is movable along the fixed blade; and a receiving element which receives the sheet piece that is cut off from the sheet, the receiving element being structured so as to be movable together with the movable blade.

According to the present invention, there is further provided a sheet cutter for cutting a sheet piece from a sheet by shearing, the sheet cutter having: a fixed blade; a movable blade which is movable along the fixed blade; and a receiving element which receives the sheet piece that is cut off from the sheet, the receiving element being structured so as to be translationally movable along a direction substantially perpendicular to a moving direction of the movable blade.

According to the present invention, there is yet further provided an image-forming apparatus having: a recording unit for recording an image onto a photosensitive material; a sheet cutter for cutting a piece of sheet from an elongated sheet; and a transfer unit for transferring the image recorded on the photosensitive material onto the piece of sheet. This sheet cutter includes a fixed blade, a movable blade which is movable along the fixed blade, and a receiving element that receives the piece of sheet which is cut off from the sheet, the receiving element being structured so as to be movable together with the movable blade.

The foregoing and other objects, features and advantages of the present invention will be apparent from the following description of a preferred embodiment of the invention, as illustrated in the accompanying drawings.

DESCRIPTION OF THE PREFERRED EMBODIMENTS

Figure 6:
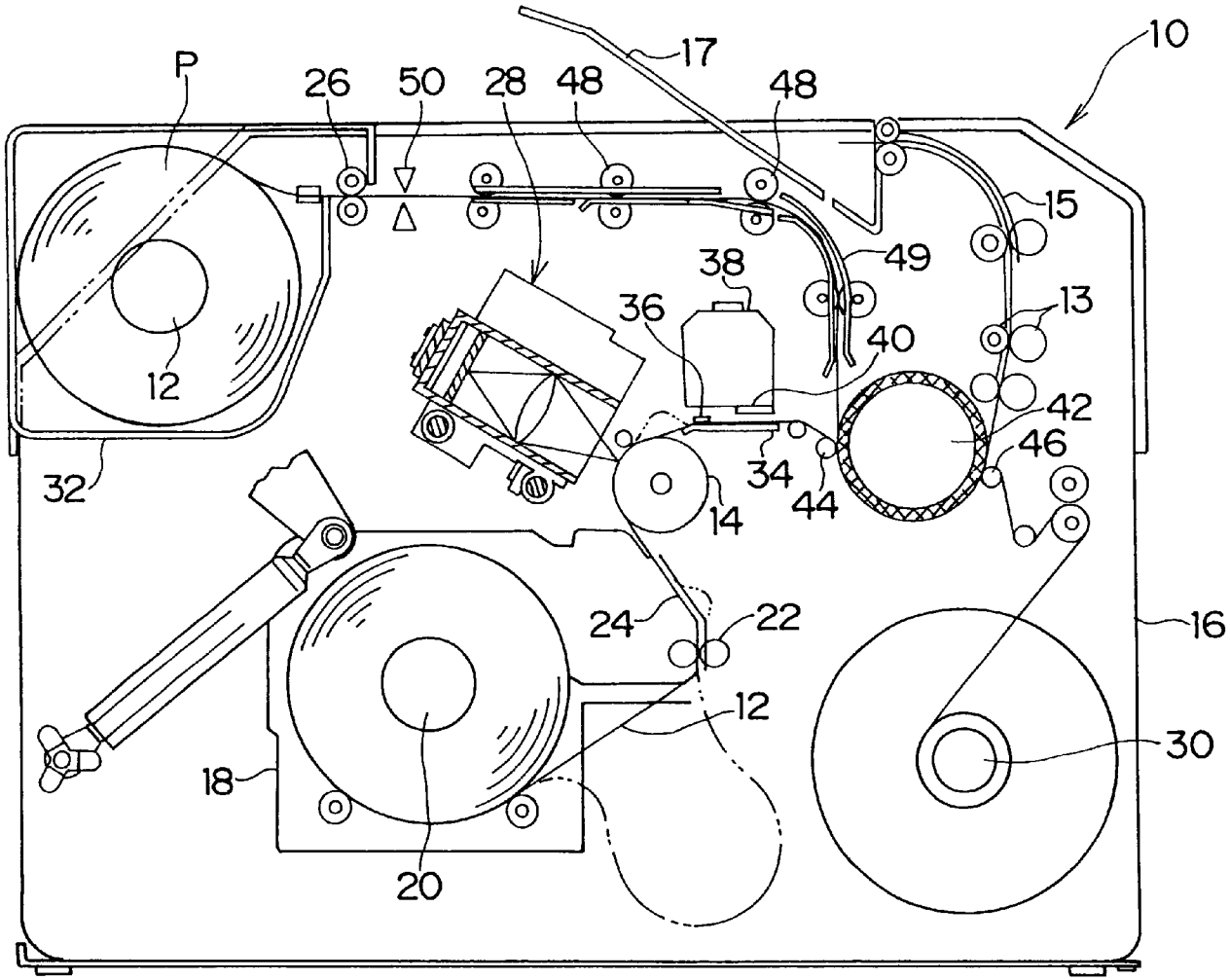
FIG. 6 is a general view of an image-forming device in which the sheet cutter according to the embodiment is provided.
Figure 7:
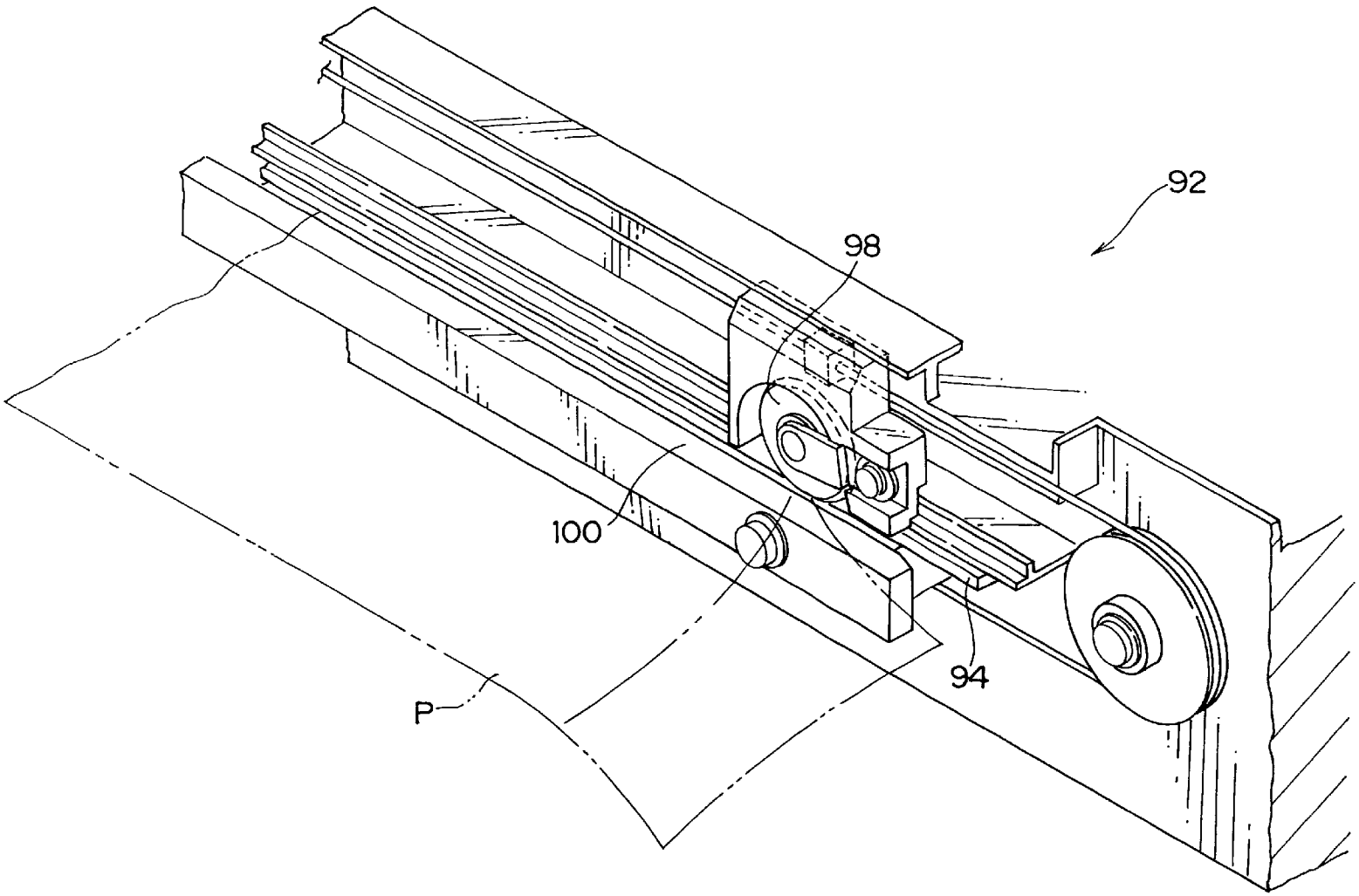
FIG. 7 PRIOR ART
FIG. 7 is a perspective view illustrating a usual structure of a conventional sheet cutter for cutting an image-receiving sheet.
Figure 8:
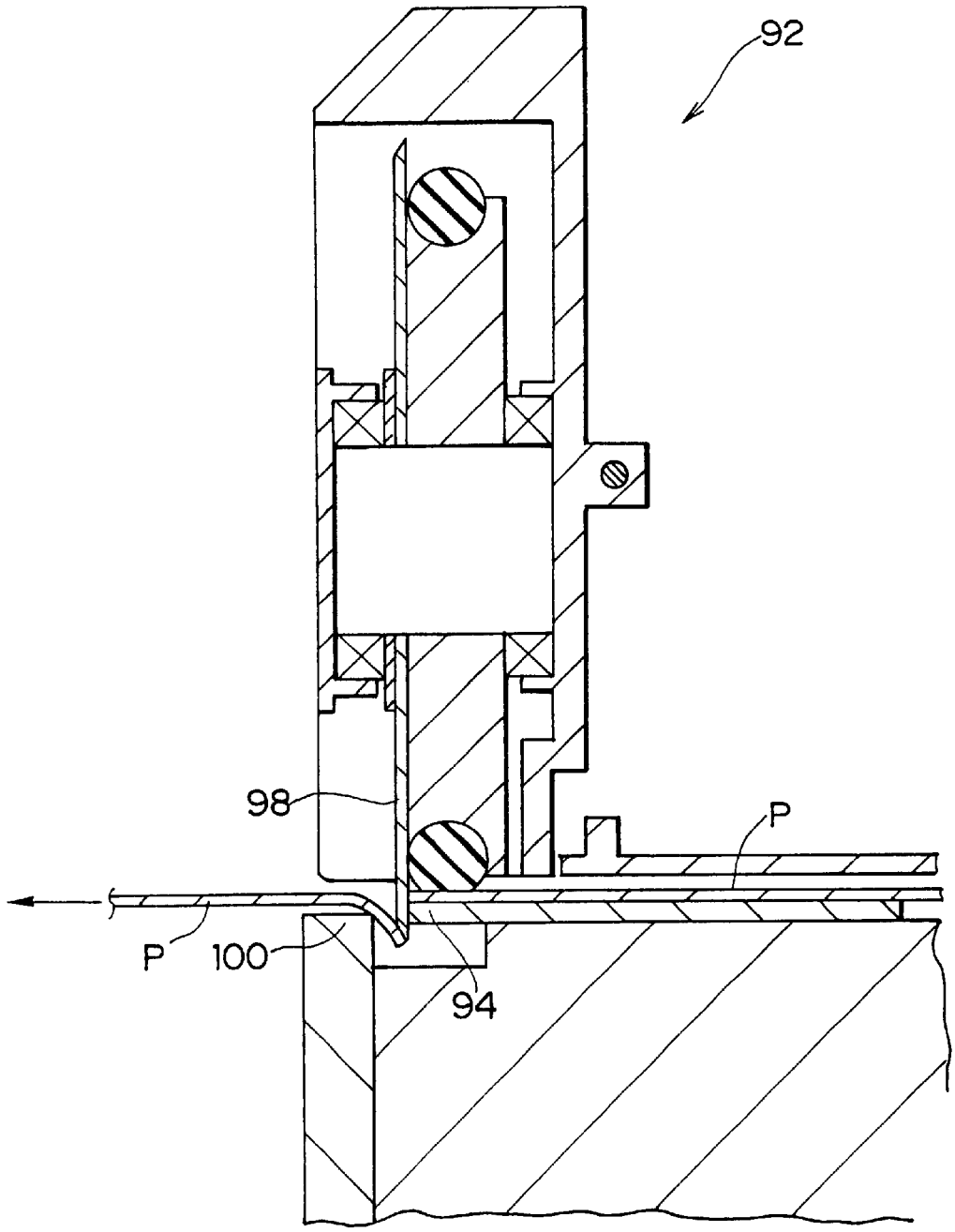
FIG. 8 PRIOR ART
FIG. 8 is a cross sectional view of the conventional sheet cutter.
Figure 9:
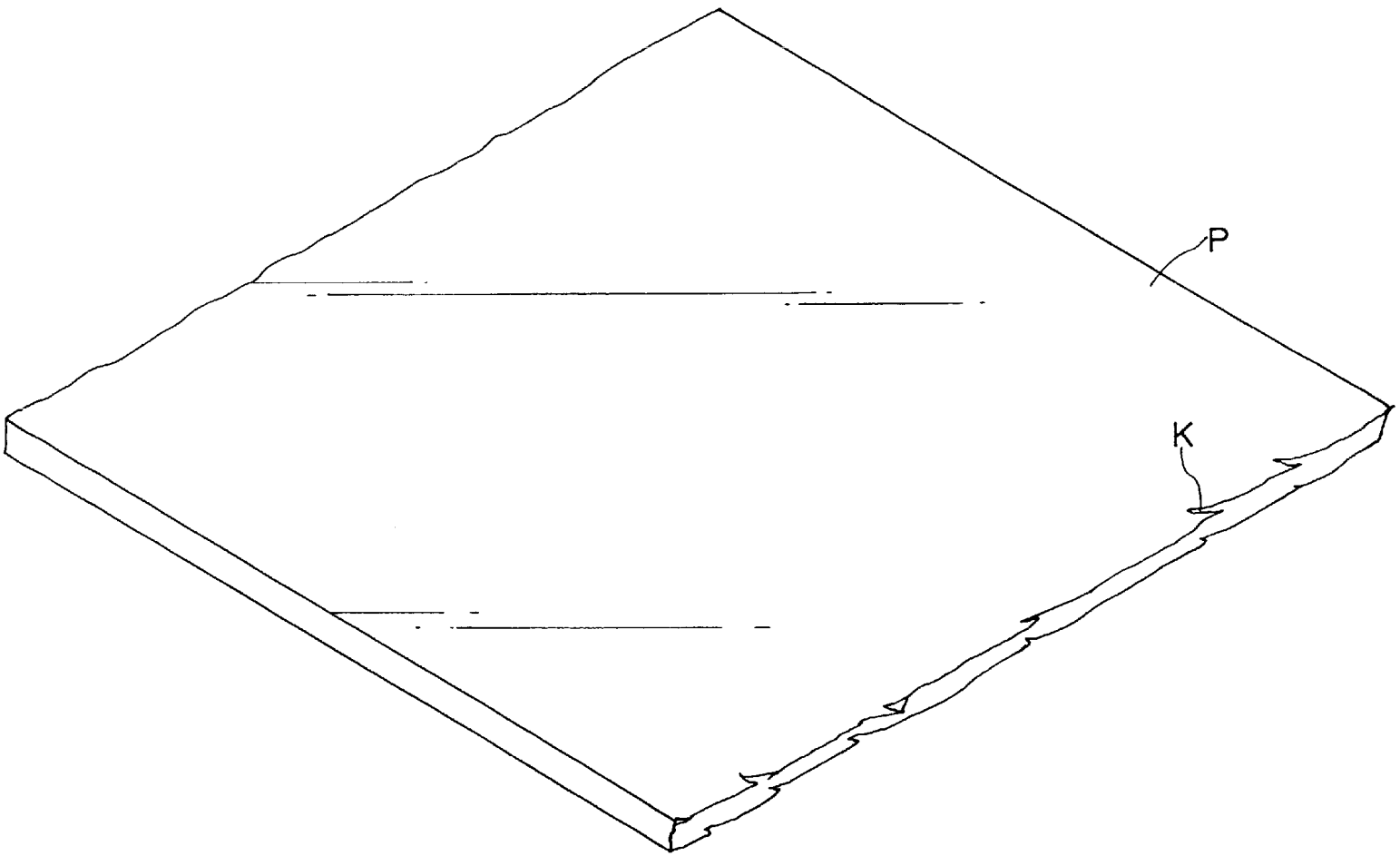
FIG. 9 PRIOR ART
FIG. 9 is a view illustrating a sheet in which there is a nap or fluff raised at a sheet edge of an image-receiving sheet.
Figure 10:
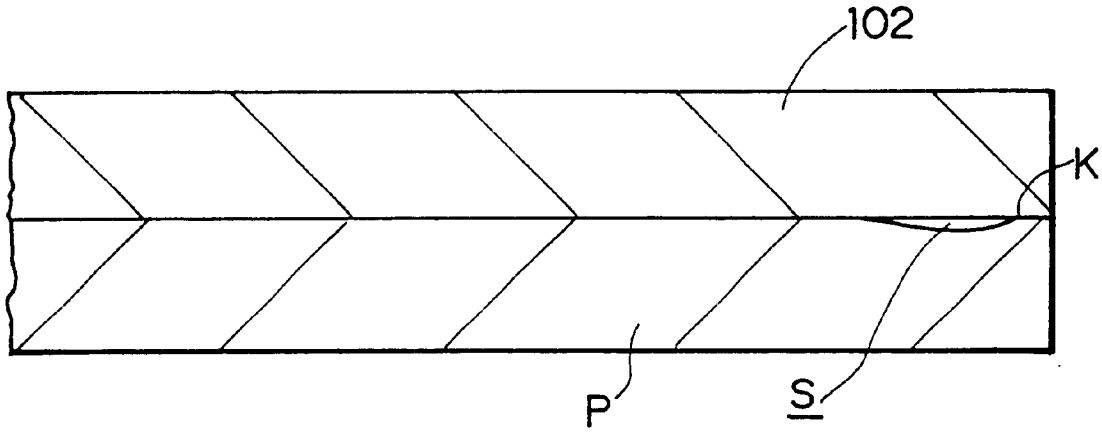
FIG. 10 PRIOR ART
FIG. 10 is a view illustrating a state in which the image-receiving sheet having the nap or fluff generated thereon and a photosensitive material are superposed.

FIG. 6 shows an image-forming apparatus 10 having a sheet cutter according to an embodiment of the present invention.

At a lower side within a housing 16 of the image-forming apparatus 10 is disposed a photosensitive material magazine 18 in which a photosensitive material 12 is set, wound-up around a supply reel 20. The supply reel 20 is driven for rotation by a driving means (not illustrated) so as to unwind the photosensitive material 12.

A distal end of the photosensitive material 12 is nipped by pulling-out rollers 22 that are provided at a securing section for the photosensitive material magazine 18. Under predetermined conditions, the pulling-out rollers 22 pull the photosensitive material and feed the same toward guide plates 24 or define a further buffer (indicated by a two-dotted line).

On passing through the guide plates 24, the photosensitive material 12 is wound around an exposure drum 14 and then image-exposed by a scanning head 28. Because the photosensitive material 12 is wound onto the exposure drum 14 and image-exposed in the manner described above, it is possible to avoid generation of wrinkles or creases with respect to the widthwise direction of the photosensitive material 12. Thus, flatness of the exposed surface can be maintained to a high level.

The image-exposed photosensitive material 12 is sandwiched between a support table 34 and a pressure plate 36, and is supplied with water by an application member 40 (a sponge or the like). The application member 40, which is water absorptive, is provided at an application tank 38.

The water-applied photosensitive material 12 is wound around a heating drum 42 with a predetermined constant pressure by tension rollers 44 and 46. The heating drum 42 has a halogen lamp incorporated therein. While the wound photosensitive material is heated, it is superposed with an upper surface of an image-receiving sheet (hereinafter referred to as a "sheet") P described in detail hereinbelow, onto which the image is transferred.

Next, the image-transferred photosensitive material 12 is wound around a scrap reel 30. As described above, the photosensitive material 12 is delivered not in a cut-off sheet manner but in a consecutive web manner from the supply reel 20 to the scrap reel 30. Therefore, the photosensitive material 12 itself functions as a timing belt which applies a certain constant pressure to the sheet P.

At an upper side within the housing 16 is disposed a sheet magazine 32, in which the sheet P is wound around a supply reel 12. The sheet P is nipped and unwound by nipping rollers 26, and thereafter a sheet piece having a predetermined length is cut off therefrom by a sheet cutter 50, details of which will be described hereinbelow. Then, the sheet piece is conveyed by guidance of conveyor rollers 48 and guide plates 49 and wound around the heating drum 42 together with the photosensitive material in an overlapping manner.

The image recorded on the photosensitive material is transferred to the sheet piece P. Thereafter, the image-transferred sheet piece is separated from the heating drum 42 and from the photosensitive material by a separation claw (not illustrated), conveyed under guidance of conveyor rollers 13 and guide plates 15, and led to a receiving tray 17.

Figure 1:
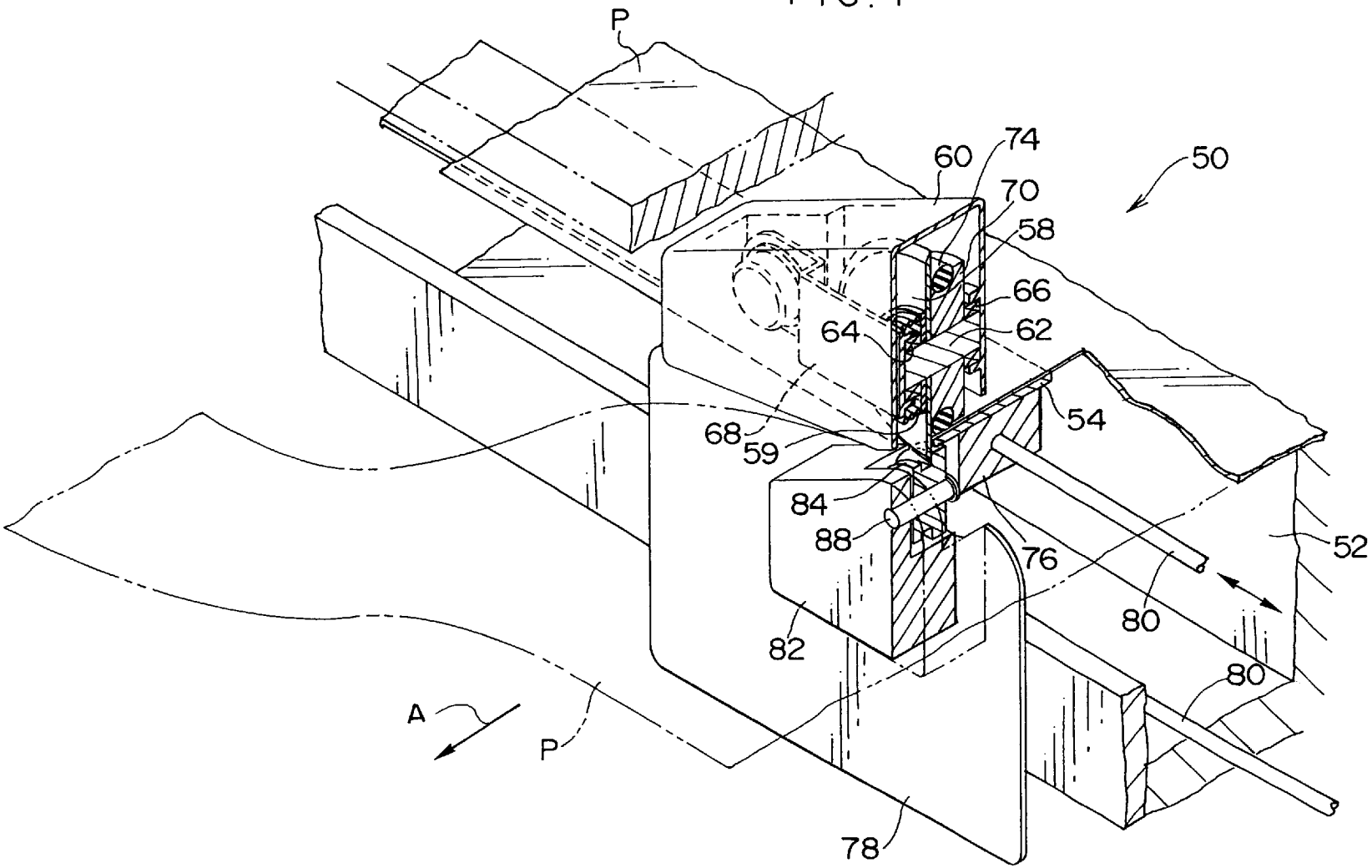
FIG. 1 is an overall perspective view illustrating a sheet cutter according to an embodiment of the invention.

Next, description will be made of the sheet cutter 50 with reference to FIGS. 1 and 2. In the sheet cutter 50, a guide rail 52 is disposed substantially perpendicular to a sheet conveying direction (indicated by arrow A), i.e., a sheet width direction. To this guide rail 52 is secured a fixed blade 54 of elongated plate shape, whose length is larger than the width of the sheet P that is coiled and stored in the sheet magazine 32.

The sheet P is conveyed over the fixed blade 54 and through an elongated slit formed in the guide rail 52. Above the fixed blade 54 is disposed an upper housing 60 which accommodates a (single-edged) rotary blade 58, part of which is exposed.

Figure 4:
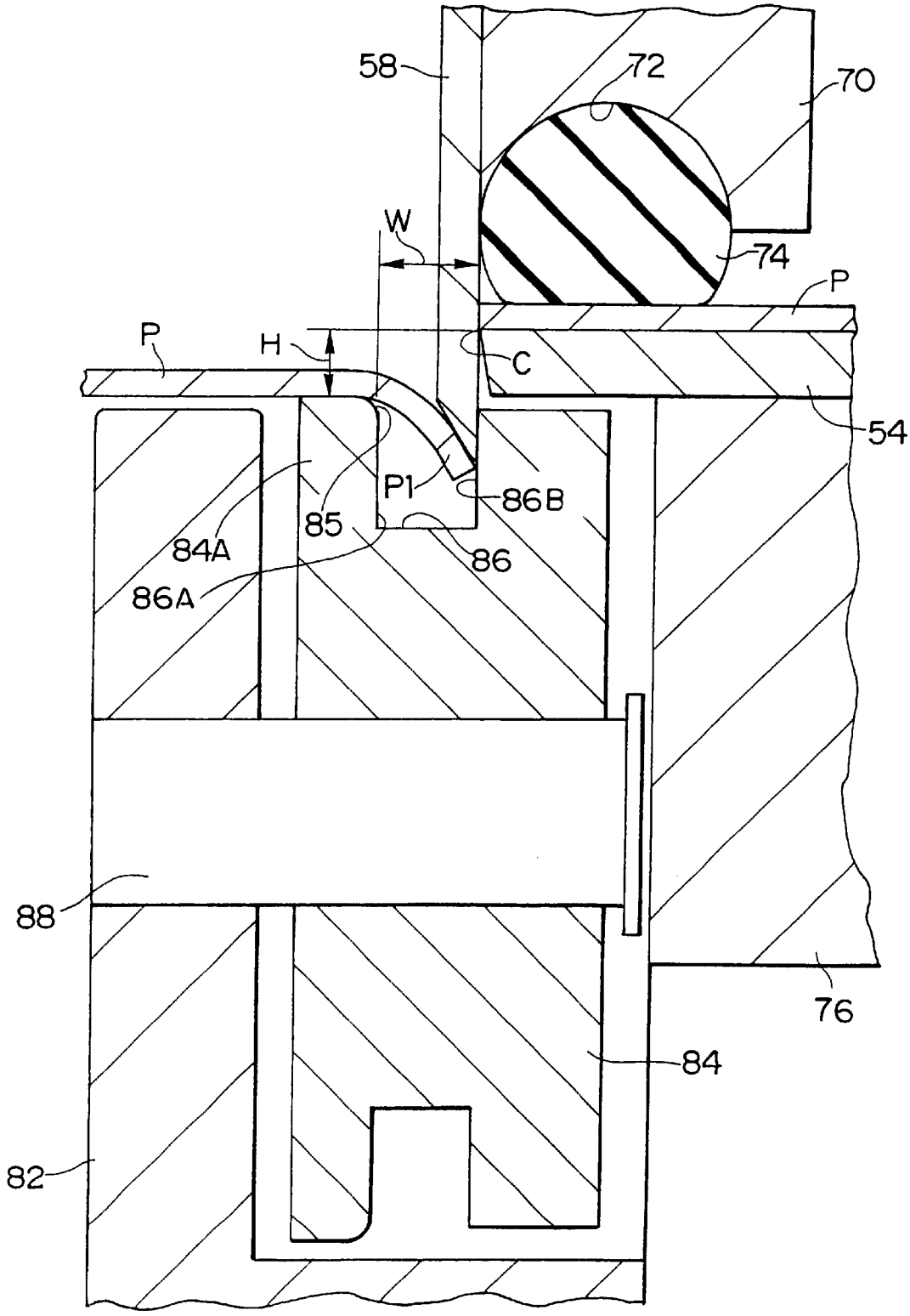
FIG. 4 is an enlarged view illustrating main portions of the sheet cutter according to the embodiment.

The rotary blade 58 has a rotatable shaft 62 with two ends, both of which ends are rotatably supported by bearings 64 and 66. The bearing 64 is secured to a cantilever-type plate member 68. Between the plate member 68 and a disk plate 61A is provided a coil spring which biases the rotary blade 58 toward the fixed blade 54. Thus, a side surface 58A of the rotary blade 58 is pressed to the fixed blade 54 at a cutting point C (see FIGS. 2 and 4). The fixed blade 54 has an upper surface and an inclined, relief surface, with these surfaces meeting at the cutting point C at an angle θ with each other (e.g., around 80°), as shown in FIG. 4. When the rotary blade 58 is moved along the fixed blade 54, the rotary blade 58 rotates due to friction, so that the sheet P is reliably cut at the cutting point C.

Also, a disk plate 70 is concentrically fixed to the rotatable shaft 62 of the rotary blade 58. The disk plate 70 has a groove 72 circumferentially defined in the external surface thereof. A seal ring, that is, an O-ring 74, is received in this groove 72. The O-ring 74 is in a slightly compressed state when moved on the upper surface of the fixed blade 54 during rotation.

A slider 76 is disposed under the fixed blade 54 such that the slider 76 opposes the O-ring 74. The slider 76 is connected to the upper housing 60 via a connection plate 78 (see FIG. 5) and slides along a back surface of the fixed blade 54. The fixed blade 54 is maintained between the O-ring 74 and the slider 76 such that up and down movement of the rotary blade 58 with respect to the fixed blade 54 is restricted.

Further, a wire 80 is fixed to the slider 76. The wire 80, which is endless, is wound around pulleys, which are disposed at each end of the guide rail 52. Power from a motor (e.g., a stepping motor) is transmitted to at least one of the pulleys through a reduction gear.

In this structure, when the sheet P has advanced to a cutting position, the motor usually rotates, and the upper housing 60 and the slider 76 are moved along the fixed blade 54. At this time, the rotary blade 58 cuts the sheet P in the sheet width direction at the cutting point C defined with the fixed blade 54. When the motor is operated in a reverse direction, the slider 76 and the upper housing 60 are pulled back to stand at a standby position.

Further, a lower housing 82 is fixed to the connection plate 78 and moves integrally with the upper housing 60. The lower housing 82 includes a rotation shaft 88 and a receiving roller 84, which serves as a receiving member, is made of metal, and is rotatably supported by the rotation shaft 88. The receiving roller 84 has a groove 86 circumferentially defined in the external surface thereof such that the edge of the rotary blade 58 is accommodated in the groove 86.

Specifically, in the structure of this embodiment, in which the rotary blade 58 and the receiving roller 84 are moved integrally, at the time the image-receiving sheet P is cut, a trailing edge portion of a piece of image-receiving sheet, which is cut off, is bent down and enters into the groove 86, as shown in FIG. 4. In short, a bent-down or hung-down portion P1 of the sheet edge of the piece is purposely formed so as to restrain or eliminate generation of burrs.

Now, the rotation shaft 88 of the receiving roller 84 is disposed parallel to the rotatable shaft 62 of the rotary blade 58. The receiving roller 84 is sidable along an axial direction of the rotation shaft 88 of the receiving roller 84.

Further, as seen in FIG. 4, a difference in elevation H between a peak of the receiving roller 84 and the cutting point C of the fixed blade 54 is set to be, for example, 0.5 mm with the groove 86 having a width of 0.75 mm. In further detail, the difference H is continuously kept constant because the fixed blade 54 is disposed between the O-ring 74 and the slider 76, and because the rotary blade 58 and the receiving roller 84 are moved integrally. The horizontal measurement W between one surface 86A defining the groove 86 and the cutting point C of the fixed blade 54 is kept constant at substantially the same value as that of the groove width (in this example, 0.75 mm) because a back surface 58A of the rotary blade 58 abuts against another surface 86B defining the groove 86 when the rotary blade 58 is moved integrally with the receiving roller 84.

The receiving roller 84 has a ring portion 84A, a portion of whose circumferential edges is curved to be a rounded part (hereinafter, R-part) 85. This R-part 85 gently abuts against the sheet back so as not to form scratches or flaws thereon. The hung-down, curved portion P1 of the sheet piece edge extends from this abutment point.

Figure 5:
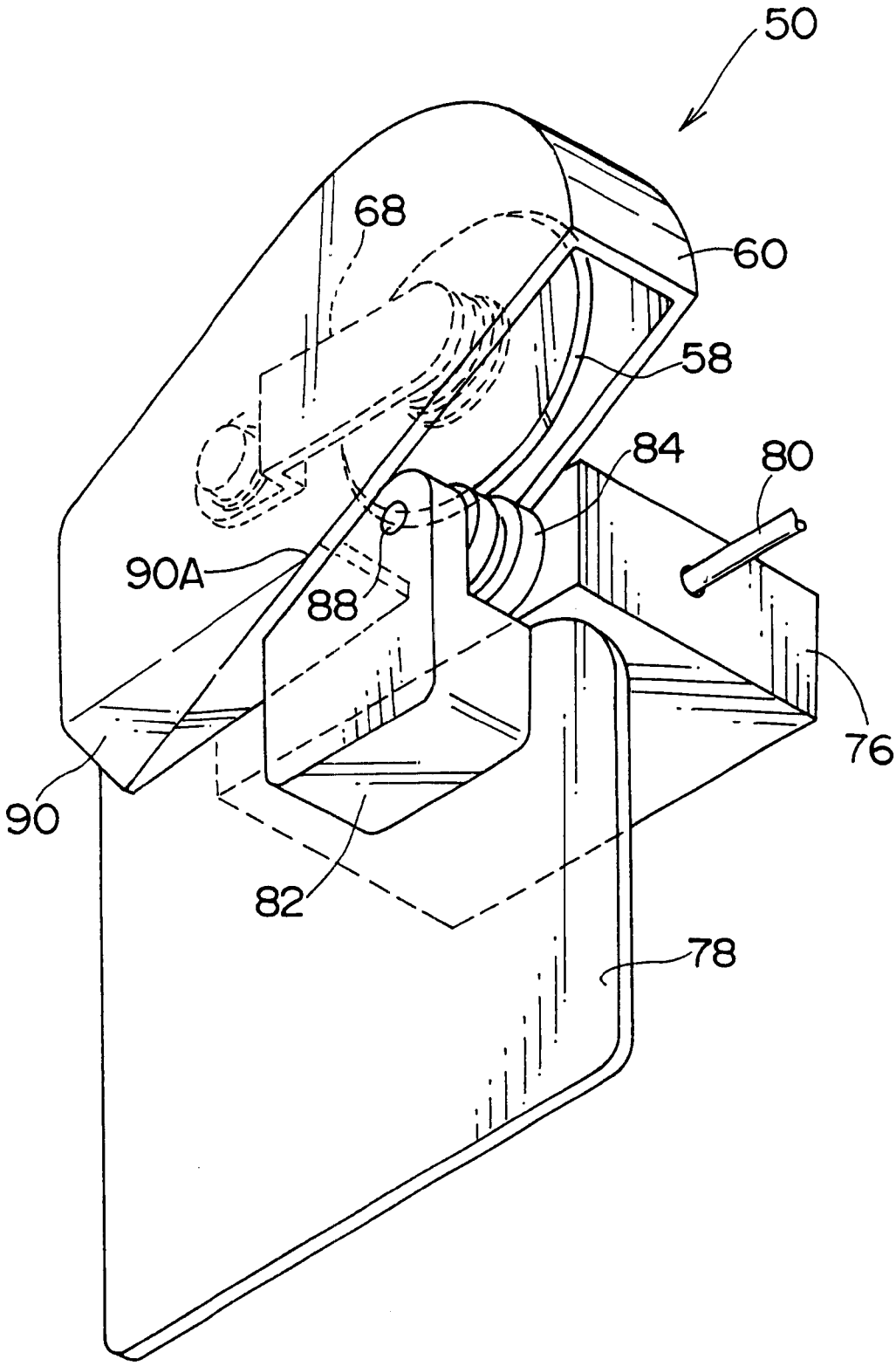
FIG. 5 is a perspective view seen from an underside of the sheet cutter according to the embodiment

Further, as shown in FIG. 5, a sheet pressing surface 90 is formed on the under side of the upper housing 60. The sheet pressing surface 90 is downwardly inclined as seen from the side. This sheet pressing surface 90, which is inclined in a direction away from the cutting line, presents a delta shape as seen from the bottom, such that a surface pressure acting therefrom onto the image-receiving sheet during a cutting process can be reduced.

Next, operation of the sheet cutter of the embodiment will be described.

Figure 2:
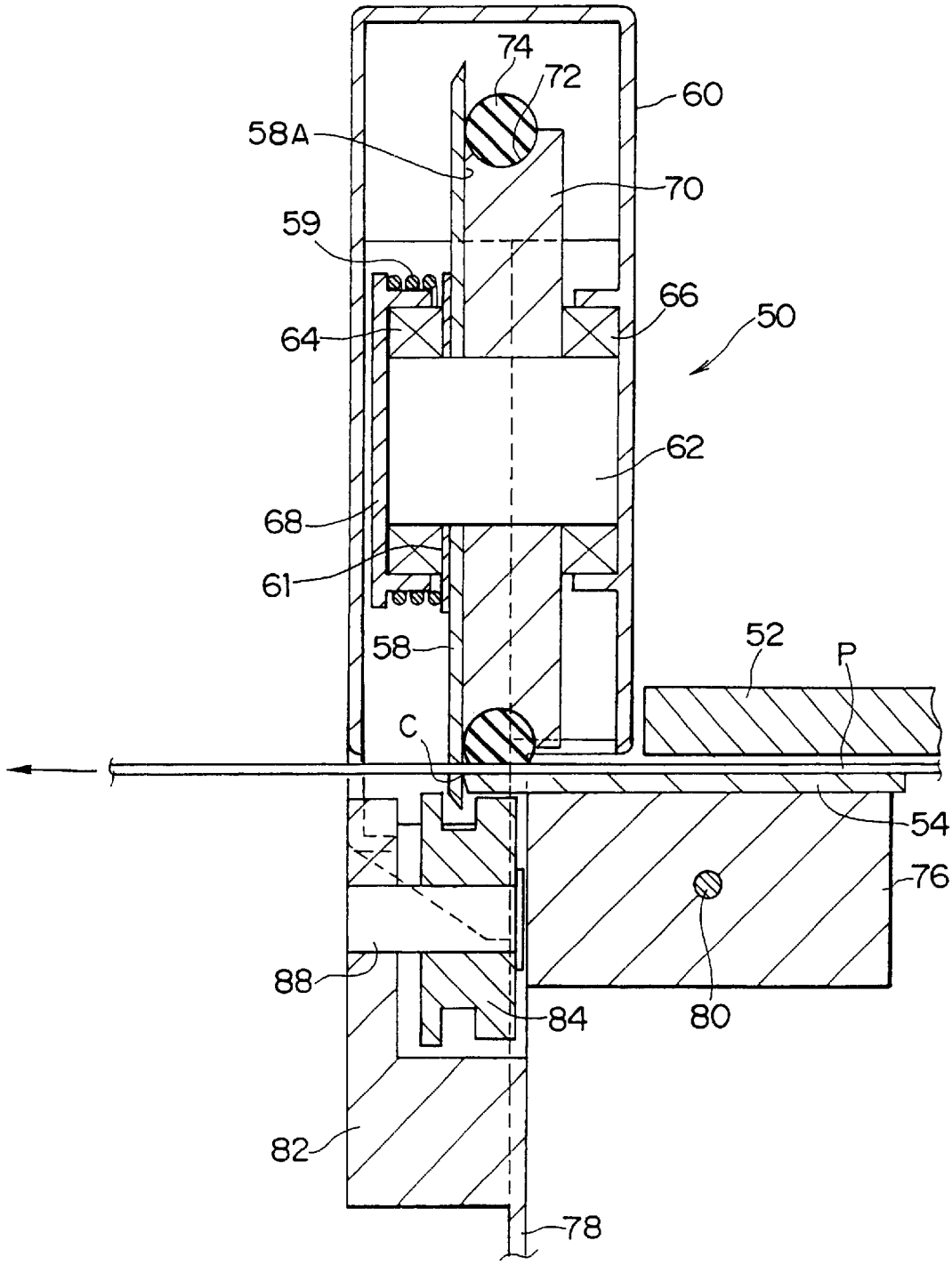
FIG. 2 is a cross sectional view illustrating the sheet cutter according to the embodiment.

As illustrated in FIG. 2, when the image-receiving sheet P has been conveyed and placed in a position (a cutting position) over the fixed blade 54, the motor starts to rotate in a forward direction. Accordingly, the upper housing 60 and the lower housing 82 are moved along the fixed blade 54 together with the slider 76.

Figure 3:
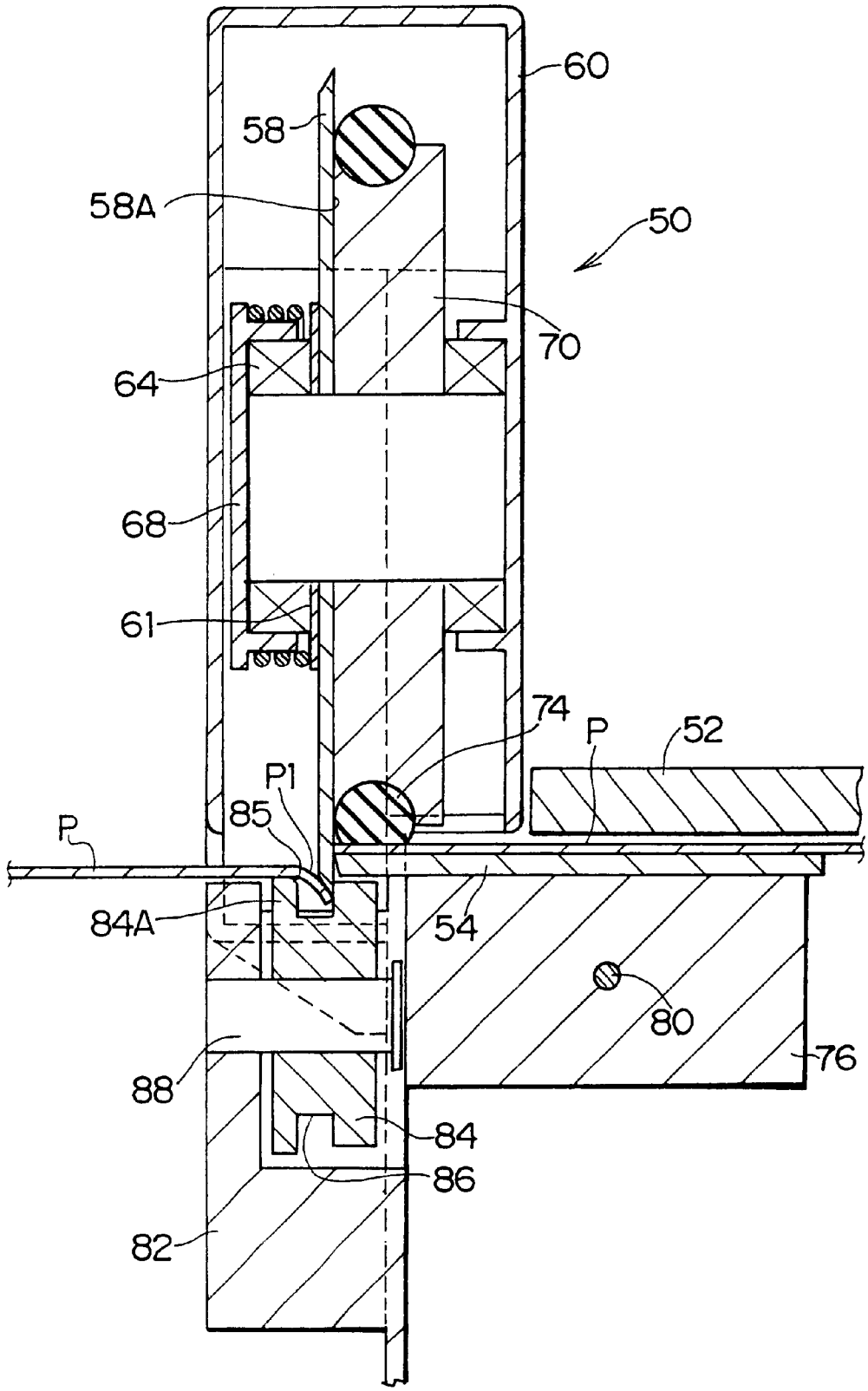
FIG. 3 is a cross sectional view illustrating the sheet cutter according to the embodiment.

The rotary blade 58, which is secured to the upper housing 60, rotates due to friction according to linear movement thereof along the fixed blade 58, due to being continuously contacted by the fixed blade 54. As illustrated in FIG. 3, the sheet P is cut at the cutting point C by an engaging action between the rotary blade 58 and the fixed blade 54.

As described above, the cut-off portion or piece of sheet is supported at a trailing end portion thereof by the receiving roller 84 when the sheet P is cut. Although a hung-down portion P1 of the sheet edge of the piece is generated, burrs and warp are not generated. The receiving roller 84 is secured to the lower housing 82 and moves integrally with the rotary blade 58.

Thus, there is no need to provide a long receiving member disposed along the fixed blade 54. The receiving member need only have a short length, enough to support the hung down portion P1 of the piece. Accordingly, the cost of the receiving member can be reduced. Further, adjustment of the receiving member with respect to the rotary blade 58 can be performed easily.

Furthermore, as the receiving roller 84 rotates due to friction with the image-receiving sheet, the back surface of the image-receiving sheet is not damaged. In addition, when the hung-down portion P1 of the piece of sheet enters into the groove 86 of the receiving roller 84, the receiving roller 84 is urged in a direction away from the fixed blade 54. Therefore, a relative positional relationship between the rotary blade 58 and the receiving roller 84 (corresponding to the horizontal distance W) is safely and reliably maintained. The vertical distance H is also maintained by the fixed blade 54 being sandwiched between the O-ring 74 and the slider 76.

Because the circumferential R-part 85 is formed at the edge of the ring portion 84A of the receiving roller 84, application of a fold line to the hung-down portion of the piece of sheet is prevented. In place of the R-part 85, a chamfered portion may be provided. Further, in the present embodiment, the receiving roller, which is rotatable and serves as the receiving member, is provided. However, a block having a smoothed surface could be employed as the receiving member.

Still further, a structure is possible in which a receiving member have a length substantially equal to the length of the fixed blade is secured to the fixed blade side so as to be translationally slidable in a direction parallel to an axial direction of the rotary blade. With such a structure, due to an urging effect by the bent-down portion of the piece of image-receiving sheet, which urges the rotary blade to slide in the axial direction of the rotary blade, the positional relationship between the receiving member and the rotary blade can be constantly maintained, in the same way as in the above embodiment.

A pressure point 90A of the sheet pressing surface 90 is formed on the upper housing 60 for pressing the sheet against the fixed blade 54 in order to reduce or even eliminate an unreasonable force which acts upon the sheet to produce surface waviness. The sheet pressing surface 90 has a shape such that surface pressure on the sheet is reduced. Thus, gloss of a film surface of the sheet does not deteriorate, and generation of dents or impressions is prevented.

Further, instead of shaping the pressure member to be a surface pressure reducing means, a slipping surface, which is formed on the pressure member or on a low friction member provided at the pressure member, may be employed. Also, rollers secured to the pressure member may be employed so as to reduce frictional force.

In the present embodiment, the image-receiving sheet is cut by the rotary blade and the fixed blade. However, a combination of a fixed blade and a non-rotary type blade, e.g., a movable straight blade of elongated plate shape, in which this movable straight blade and a receiving member are moved integrally is also possible.

Still further, instead of providing one receiving roller, a pair of receiving rollers disposed one at each side of the rotary blade may be provided. Of these two receiving rollers, the receiving roller disposed closer to the fixed blade may be omitted, depending on circumstances.

What is claimed is:

1. A sheet cutter for cutting a sheet piece from a sheet by shearing, the sheet cutter comprising:

a fixed blade;

a movable blade which is movable along the fixed blade; and a receiving element which receives the sheet piece that is cut off from the sheet, the receiving element being structured so as to be movable together with the movable blade, wherein the receiving element comprises a roller which is rotatably supported.

2. The sheet cutter of claim 1, further comprising a support for supporting the movable blade and a support for supporting the receiving element, the supports being substantially integral with each other.

3. The sheet cutter of claim 1, wherein the movable blade comprises a disk which is rotatably supported.

4. The sheet cutter of claim 1, further comprising a sheet pressing structure which is disposed at a movable blade side of the sheet, the sheet pressing structure including a reducing element which reduces surface pressure that acts on a surface of the sheet during cutting.

5. The sheet cutter of claim 1, wherein the receiving element has a groove that receives an edge portion of the sheet piece which is cut off, which edge portion is in a hung-down state after cutting.

6. The sheet cutter of claim 5, wherein a circumferential edge of the groove of the receiving element is chamfered so as not to damage the sheet piece.

7. A sheet cutter for cutting a sheet piece from a sheet by shearing, the sheet cutter comprising:

a fixed blade;

a movable blade which is movable along the fixed blade; and a receiving element which receives the sheet piece that is cut off from the sheet, the receiving element being structured such that the entire receiving element is translationally movable along a direction substantially perpendicular to a moving direction of the movable blade.

8. The sheet cutter of claim 7, further comprising a support for supporting the movable blade and a support for supporting the receiving element, the supports being substantially integral with each other.

9. The sheet cutter of claim 7, wherein the movable blade comprises a disk which is rotatably supported.

10. The sheet cutter of claim 7, wherein the receiving element comprises a roller which is rotatably supported.

11. The sheet cutter of claim 7, further comprising a sheet pressing structure which is disposed at a movable blade side of the sheet, the sheet pressing structure including a reducing element which reduces surface pressure that acts on a surface of the sheet during cutting.

12. The sheet cutter of claim 7, wherein the receiving element has a groove that receives an edge portion of the sheet piece which is cut off, which edge portion is in a hung-down state after cutting.

13. The sheet cutter of claim 12, wherein a circumferential edge of the groove of the receiving element is chamfered so as not to damage the sheet piece.

14. An image-forming apparatus comprising:

a recording unit for recording an image onto a photosensitive material;

a sheet cutter for cutting a piece of sheet from an elongated sheet; and a transfer unit for transferring the image recorded on the photosensitive material onto the piece of sheet, wherein the sheet cutter includes a fixed blade, a movable blade which is movable along the fixed blade, and a receiving element that receives the piece of sheet which is cut off from the sheet, the receiving element being structured so as to be movable together with the movable blade, wherein the receiving element is structured so as to be translationally movable in a direction substantially perpendicular to a moving direction of the mobable blade.

15. The image-forming apparatus of claim 14, further comprising a support for supporting the movable blade and a support for supporting the receiving element, the supports being substantially integral with each other.

16. The image-forming apparatus of claim 14, wherein the movable blade comprises a disk which is rotatably supported, and the receiving element comprises a roller which is rotatably supported.

17. The image-forming apparatus of claim 14, further comprising a sheet pressing structure which is disposed at a movable blade side of the sheet, the sheet pressing structure including a reducing element which reduces surface pressure that acts on a surface of the sheet during cutting.

18. The image-forming apparatus of claim 14, wherein the receiving element has a groove that receives an edge portion of the piece of sheet which is cut off, which edge portion is in a hung-down state after cutting, and a circumferential edge of the groove of the receiving element is chamfered so as not to damage the piece of sheet.

* * * * *